United States Patent [19]

Hoeptner, III

[11] Patent Number: 4,854,339

[45] Date of Patent: Aug. 8, 1989

[54] FREEZE VALVE APPARATUS

[76] Inventor: Herbert W. Hoeptner, III, 15085 Venetian Way, Morgan Hill, Calif. 95037

[21] Appl. No.: 297,124

[22] Filed: Jan. 17, 1989

[51] Int. Cl.[4] ..... E03B 7/12; E03B 9/14

[52] U.S. Cl. ..... 137/282; 137/301; 137/892; 239/124

[58] Field of Search ..... 137/272, 281, 282, 291, 137/301, 302, 565, 570, 888, 891, 892, 893; 239/124, 204, 205, 206; 138/27, 32, 35; 417/151

[56] References Cited

U.S. PATENT DOCUMENTS

| | | | |
|---|---|---|---|
| 196,384 | 10/1877 | Porteous | 137/282 |
| 1,786,357 | 12/1930 | Miller | 137/892 |
| 1,987,883 | 1/1935 | White et al. | 137/892 |
| 2,580,199 | 12/1951 | Schmid | 137/301 |
| 2,598,968 | 6/1952 | Boosey | 137/301 |
| 2,605,781 | 8/1952 | Schmid et al. | 137/301 |
| 3,017,896 | 1/1962 | Papacek | 137/302 |
| 3,770,003 | 11/1973 | Uroshevich | 137/281 |
| 4,109,671 | 8/1978 | Hughes et al. | 137/282 |
| 4,653,521 | 3/1987 | Fillman | 137/302 |
| 4,653,522 | 3/1987 | Fillman et al. | 137/302 |

*Primary Examiner*—George L. Walton
*Attorney, Agent, or Firm*—William W. Haefliger

[57] ABSTRACT

Freeze resisting valve apparatus, for controlling water flow, includes: a vertically elongated, hollow valve body having a lower portion adapted for installation underground, the body having a lower water inlet associated with that lower portion, and an upper water outlet, for passing a stream of pressurized water through the body; a water reservoir adapted for installation underground and having communication with the body lower portion via a port; a valve seat in the lower portion of the body and having a narrowed passage positioned to increase pressurized water flow velocity in proximity to the port; and a stopper movable toward and away from the seat to effect drainage of water in the valve body downwardly past the stopper to the reservoir when the stopper is closed on the seat, and to effect inducing of water flow from the reservoir and into the stream via the seat passage when the stopper is retracted from the seat.

11 Claims, 1 Drawing Sheet

FREEZE VALVE APPARATUS

BACKGROUND OF THE INVENTION

This invention relates generally to freeze resisting valves, and more particularly to valves installable in such relation to the ground as to resist freeze-up in cold weather.

Freezing of water control valves in winter, as for example in remote locations, such as farms, ranches, etc. has been a persistent problem. There is need for a simple, reliable valve that does not require heating, as by electricity or other means, and that will resist, and prevent, freeze-up in normal winter conditions.

SUMMARY OF THE INVENTION

It is a major object of the invention to provide a simple, reliable valve apparatus to meet the above need. Basically, the apparatus is adapted to control water flow, and includes:

(a) a vertically elongated, hollow valve body having a lower portion adapted for installation underground, the body having a lower water inlet associated with said lower portion, and an upper water outlet, for passing a stream of pressurized water through said body, (b) a water reservoir adapted for installation underground and having communication with said body lower portion via a port, (c) a valve seat in said lower portion of the body and having a narrowed passage positioned to increase pressurized water flow velocity in proximity to said port, (d) and a stopper movable toward and away from the seat to effect drainage of water in the valve body downwardly past the stopper to the reservoir when the stopper is closed on the seat, and to effect inducing of water flow from the reservoir and into said stream via the seat passage when the stopper is retracted from the seat.

The water in the reservoir does not freeze due to the fact that the reservoir is underground and in contact with the ground to receive ground stored heat. As will appear, the reservoir typically extends adjacent said body lower portion, the port located in the side of said body; and the reservoir may be annular to extend about the valve body lower portion, which is tubular and upright, the seat and stopper surrounded by the reservoir.

Another object is to provide a stopper that defines openings via which water may flow vertically in said body, past the stopper, when the stopper is retracted away from the passage in the seat. Typically, the stopper has a lowermost closure located to engage the seat to close said passage; and the closure is advantageously tapered downwardly to define a lowermost tip centrally of said body, and said passage is also located centrally of said body to receive said tip.

A further object is to provide a breather duct communicating with said reservoir and extending upwardly toward an outlet, above ground level. A vent valve is typically provided in the breather duct to close when pressurized water in the body exerts pressure on the water in the reservoir. Also, a control valve is typically provided in series with the outlet, downstream of the stopper.

These and other objects and advantages of the invention, as well as the details of an illustrative embodiment, will be more fully understood from the following specification and drawings, in which:

DRAWING DESCRIPTION

DETAILED DESCRIPTION

Figure 1:
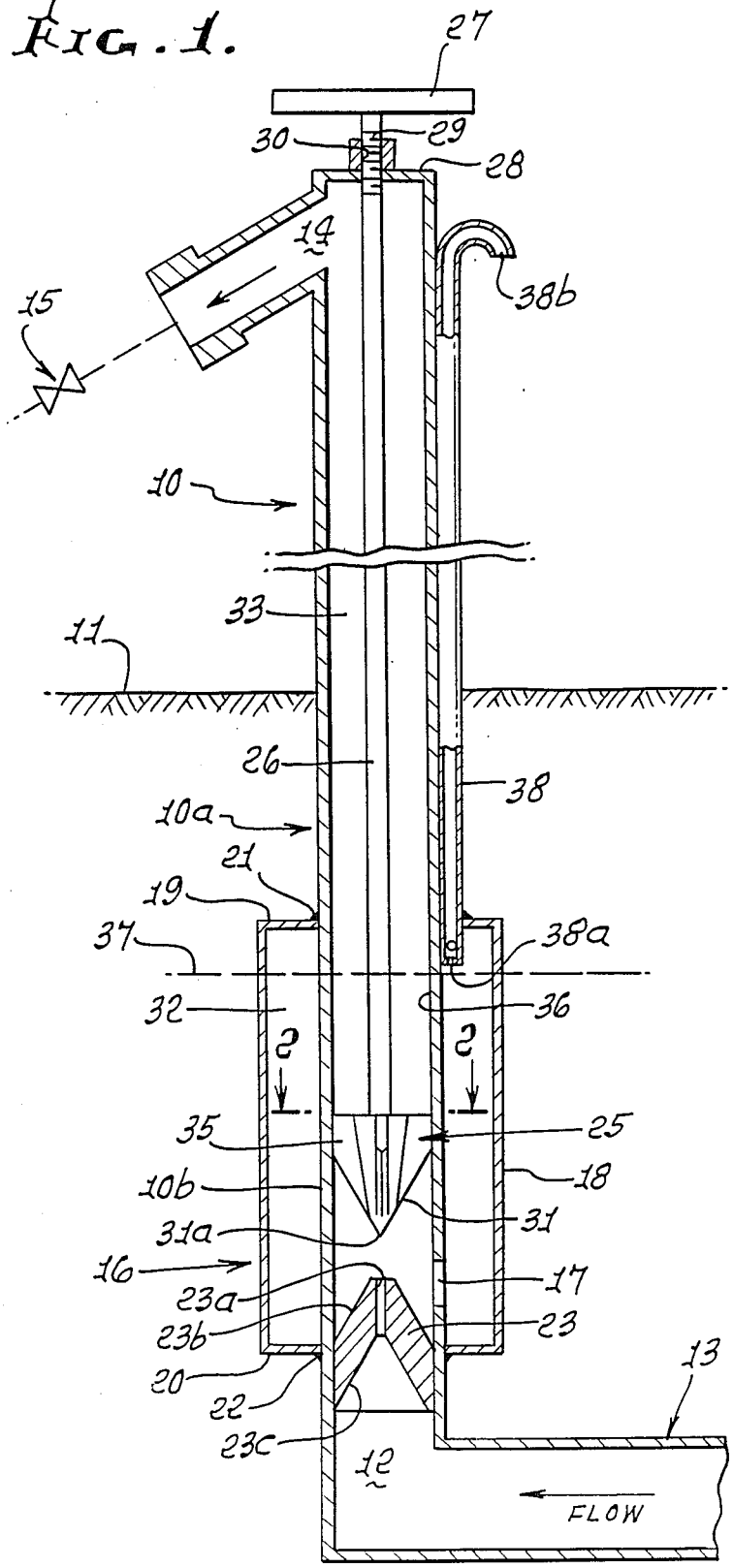
FIG. 1 is an elevation in section, showing the freeze resisting valve in open condition, the reservoir extending underground.

In the drawings, the vertically elongated, hollow valve body 10 may be tubular, as shown. It has a lower portion 10*a* adapted for installation underground, and in this regard, ground surface level may for example be located at 11. The body lower portion 10*a* has a lower water inlet 12 to receive water from an underground pipe 13. The body 10 also has upper water outlet, as at 14, for passing a stream of pressurized water upwardly through the body 10 when the valve apparatus is open, and when a downstream control valve 15 is also open, the latter valve being employed if needed.

A water reservoir 16 is provided and is adapted for installation underground, and to have communication with the body lower portion 10*a*, as via an ejector port. The latter is typically located in the side wall 10*b* of the body lower portion 10*a*, and is indicated at 17. The reservoir may be annular as shown, with a cylindrical outer wall 18, and top and bottom annular walls 19 and 20 attached to body 10 at 21 and 22.

A valve seat 23 is located in the body lower portion 10*a*, and has a narrowed passage 23*a* positioned to increase pressurized water flow velocity in proximity to the port 17. Thus the seat may act as a venturi. Note in the example the upwardly tapered upper and lower walls 23*b* and 23*c* of the seat, passage 23*a* being centered relative to the body lower portion 10*a*. Upward velocity of water exiting from passage 23*a* is enhanced, so that associated water pressure is reduced, whereby water that has drained into the reservoir from the valve body upper portion (above ground) when the valve was closed, is induced via port 17 into the water stream passing to outlet 14, to empty, or substantially empty the reservoir, above the level of port 17, when the valve is opened.

Figure 2:
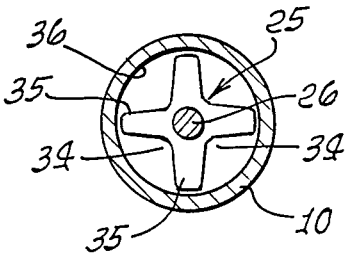
FIG. 2 is a section on lines 2—2 of FIG. 1.
Figure 3:
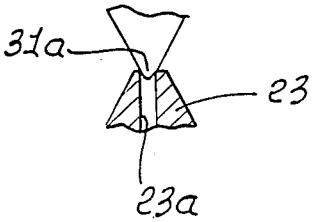
FIG. 3 is a section showing the valve stopper in closed position.

A stopper or stopper valve member 25 is provided in the body 10 to be movable up and down, as by stem 26 and handle 27. Stem extends axially within the body 10 and handle 27 is located above the upper end 28 of the body. Threads may be provided at 29 and 30 to allow turning of the handle to raise and lower the stopper. The stopper has a downwardly tapered surface at 31 so that a lowermost apex such as a tapered lower tip or centered closure 31*a* may enter the upper end of the passage 23*a* to seat therein and close the valve when the stopper is lowered. See FIG. 3. In that position water drains into the reservoir interior 32 from the valve body interior 33, via the port 17. The stopper defines openings 34 above tip 31*a* that are vertically open to drain water toward the port. Flutes 35 are formed by the stopper to project radially and loosely center the stopper in body bore 36. See FIG. 2. A typical valve surface level of water in the reservoir and in the valve body lower portion 10*a* is indicated at 37, when the valve is closed. Level 37 is below ground surface level, so that all water that remains in the valve apparatus after stopper closing is below ground level to receive ground heat, preventing freezing.

A breather duct 38 communicates at its lower ported end 38*a* with the reservoir interior; and the duct extends upwardly and above ground level, i.e., to an outlet 38*b*.

Figure 4:
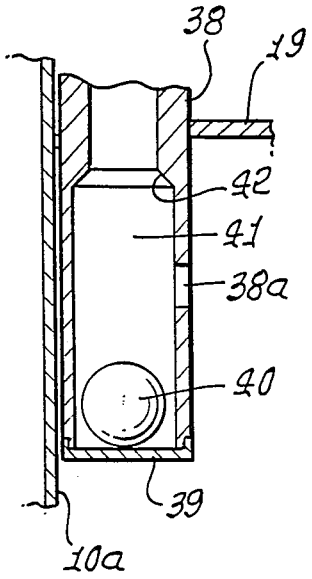
FIG. 4 is an enlarged fragmentary section showing vent valve apparatus.

In FIG. 4, a cap 39 closes the lower end of the duct 38, port 38*a* being located in the side of the duct just above the cap, below wall 19. A ball 40 is caged in chamber 41 above cap 39 and below annular seat 42, coaxial with duct 38. The density of the ball is less than that of water, so that it rises toward seat 42 as water fills chamber 41.

In operation, the vent valve is normally open, permitting the reservoir interior to breath, i.e., communicate with the exterior, via duct 38, as during filling and draining. The vent will close, i.e., ball 40 will seat at 42, only when the water in the reservoir rises and seeks to escape via duct 38 to the exterior. This can happen when control valve 15 closes.

I claim:

1. In freeze resisting valve apparatus, for controlling water flow, the combination comprising:

(a) a vertically elongated, hollow valve body having a lower portion adapted for installation underground, the body having a lower water inlet associated with said lower portion, and an upper water outlet, for passing a stream of pressurized water through said body, (b) a water reservoir adapted for installation underground and having communication with said body lower portion via an ejector port, (c) a valve seat projecting in said lower portion of the body and having a narrowed passage extending upwardly and positioned to increase pressurized water flow velocity in proximity to said port, said ejector port being proximate the level of said seat, (d) and a downwardly tapered stopper valve member having flutes thereon projecting radially to loosely center the stopper member in the body, the stopper member tapering downwardly toward an apex always remaining in alignment with said narrowed passage as the stopper member moves toward and away from the seat to effect drainage of water in the valve body downwardly past the stopper between the flutes to the reservoir when the stopper is closed on the seat with said apex at said narrow passage, and to effect inducing of water flow from the reservoir through said ejector port and into said stream and then upwardly between the flutes when the stopper is retracted upwardly from the seat, (e) said reservoir being substantially coaxial with the stopper valve member and seat.

2. The apparatus of claim 1 wherein said reservoir extends adjacent said body lower portion, the port located in the side of said body.

3. The apparatus of claim 2 wherein the reservoir extends about the body lower portion, which is tubular.

4. The apparatus of claim 3 wherein the seat and stopper valve member are surrounded by the reservoir.

5. The apparatus of claim 1 wherein said apex defines a lowermost tip centrally of said body, and said passage is also located centrally of said body to receive said tip.

6. The apparatus of claim 1 including a breather duct communicating with said reservoir and extending upwardly toward an outlet, above ground level.

7. The apparatus of claim 6 including vent valve means associated with said breather duct to pass air from the reservoir to the duct as water enters the reservoir, and to pass air into the reservoir via the duct when water flows from the reservoir into said body.

8. The apparatus of claim 1 including a control valve connected in series with said outlet downstream of the stopper.

9. The apparatus of claim 1 including a stem in the valve body connected to the stopper valve member, and a handle outside the body, which is manipulable to raise and lower the stopper valve member.

10. The apparatus of claim 1 wherein said seat has a lower side tapering upwardly toward said passage.

11. The apparatus of claim 1 wherein the ejector port is proximate the bottom of the reservoir.

* * * * *